United States Patent [19]

Damon

[11] Patent Number: 5,011,316

[45] Date of Patent: Apr. 30, 1991

[54] HAND-HELD SOAP-HOLDER

[76] Inventor: Victor A. Damon, Bldg. 4, Suite 310, 533 S. Broad St., Meriden, Conn. 06450

[21] Appl. No.: 569,709

[22] Filed: Aug. 20, 1990

Related U.S. Application Data

[63] Continuation-in-part of Ser. No. 526,241, May 18, 1990, abandoned, which is a continuation-in-part of Ser. No. 363,407, May 22, 1989, abandoned, which is a continuation-in-part of Ser. No. 175,337, Mar. 30, 1988, abandoned.

[51] Int. Cl.[5] ..... A46B 5/02; A47J 45/00; A45D 42/14; A47B 91/00

[52] U.S. Cl. ..... 401/6; 401/48; 294/64.1; 294/65; 248/346.1; 248/362; 248/206.3

[58] Field of Search ..... 401/6–8, 401/48, 49; 206/77.1; 248/205.5, 205.6, 206.3, 346.1, 359 A, 359 D, 362; 252/92, 93, DIG. 16; D28/8.1; D6/536, 540; 294/64.1, 65

[56] References Cited

U.S. PATENT DOCUMENTS

| | | | |
|---|---|---|---|
| D. 211,888 | 8/1968 | Hall et al. . | |
| 1,787,660 | 1/1931 | Blakeley . | |
| 2,099,484 | 11/1937 | Hokerk . | |
| 2,194,997 | 3/1940 | Butler . | |
| 2,283,988 | 5/1942 | Heath . | |
| 2,466,502 | 4/1949 | Stiller . | |
| 2,770,071 | 11/1956 | Endres . | |
| 2,883,791 | 4/1959 | Ballo . | |
| 3,071,886 | 1/1963 | Stiller . | |
| 3,100,363 | 8/1963 | Staver . | |
| 3,101,567 | 8/1963 | Stiller . | |
| 3,262,421 | 7/1966 | Staver . | |
| 3,542,411 | 11/1970 | Filas | 294/64.1 |
| 3,608,853 | 9/1971 | Sertich . | |
| 3,697,111 | 10/1972 | Thompson . | |
| 4,211,445 | 7/1980 | Woods | 294/64.1 X |

FOREIGN PATENT DOCUMENTS

| | | | |
|---|---|---|---|
| 441595 | 1/1968 | Switzerland | 294/64.1 |
| 572281 | 10/1945 | United Kingdom . | |

*Primary Examiner*—Danton D. DeMille

[57] ABSTRACT

A hand-held soap-holder conveniently attached to a bar of soap to prevent the soap from being dropped when wet and slippery, and to provide significantly greater control and maneverability of the soap in normal, vigorous shower use and other bathing situations. The device is easily attached by pressing its base portion firmly onto a wet bar of soap. This action implants relatively small, underlying pegs into the soat and engages relatively small-diameter suction cups securely with the soap surface. A vertical stem portion is gripped comfortably between two adjacent fingers, and the device remains reliably stable during use in the shower, tub-bath, or at sink-side. The base portion includes an outwardly positioned, flexible support-flap, which adjusts to the original shapes and contours of a wide variety of common commercial soaps. The support-flap will continue to adjust to those soaps after they erode and shrink during use-life. The vertical stem is designed to allow a quick and stable exchange of the soap back and forth between hands. The invention also includes embodiments designed specifically for flat-surfaced soaps.

20 Claims, 3 Drawing Sheets

HAND-HELD SOAP-HOLDER

This application is a continuation-in-part of application Ser. No. 07/526,241, now abandoned, which was filed on May 18, 1990, as a continuation-in-part of application Ser. No. 07/363,407, now abandoned, which was filed on May 22, 1989, as a continuation-in-part of application Ser. No. 07/175,337, now abandoned, which was filed on Mar. 30, 1988.

FIELD OF THE INVENTION

This invention relates generally to devices that are attached to a bar of soap to aid the user in holding the soap during various bathing situations.

DESCRIPTION OF THE PRIOR ART

Prior art reveals many soap-holders or other restraining devices as solutions to the well-known problem of controlling wet, slippery bar soap during bathing. With the exception of the "soap-on-a-rope" concept, none has received enduring consumer acceptance, as evident by their absence in the current marketplace. Also related to the field are soap-holding receptacles designed for storage and/or drainage purposes with the soap at static rest.

Listed below are the following patents relevant to the scope of this invention of which this inventor is aware:

| Pat. No. | Patentee | Comments |
|---|---|---|
| 1,787,660 | Blakeley 1931 (issue year) | A hand-held soap-holder including a finger-clasping band holding the soap in the palm, with band incorporated in the soap at time of soap manufacture; |
| 2,099,484 | Hokerk 1937 | A neck-rope partially encased within a bar of soap at the time of soap manufacture; apparently the original "soap-on-a-rope" invention; |
| 2,194,997 | Butler 1940 | A hand-held soap-holder in the form of a relatively large, single suction cup for attaching to a bar of soap, with an element to be gripped in the hand; |
| 2,283,988 | Heath 1942 | A hand-held soap-holder including adjustable jaws for gripping various sized bars of soap; |
| 2,466,502 | Stiller 1949 | Opposed suction cups on a sheet-form used as a wall-mounted attachment device for drying soap and as a hand-held soap-holder. |
| 2,770,071 | Endres 1956 | A hand-held soap-holder consisting of an adjustable claw-like mechanical device which stores on a hook; |
| 2,883,791 | Ballo 1959 | A hand-held soap-holder with an elastic band attached and stored internally of the soap; incorporated at the time of soap manufacture; |
| 3,071,886 | Stiller 1963 | An improved version of the Stiller patent '502 above allowing convex soaps to be attached to a wall-mounted pad of opposed suction cups; |
| 3,100,363 | Staver 1963 | A hand-held soap-holder incorporated at the time of soap manufacture and including a stem to be gripped between adjacent fingers; |
| 3,101,567 | Stiller 1963 | Various wall-mounted devices using suction cups for soap attachment and incorporating a mechanical means for improving suction strength |
| 3,262,421 | Staver 1966 | An improved version of the Staver patent '363 above with a gripping ridge on the soap coupled with an improved stem design; |
| D.211,888 | Hall & Milow 1968 | An ornamental design for a soap-holder, intended for use as a receptacle for soap when not in use; |
| 3,542,411 | Filas 1970 | A hand-held soap-holder comprising a block-like member for gripping and suction cups disposed beneath; |
| 3,608,853 | Sertich 1971 | A wall-mounted soap-holder incorporating suction cups with a means of adjusting to varied soap curvatures; |
| 3,697,111 | Thompson 1972 | A hand-held soap-holder incorporating a suction cup, a pointed stud within the cup, and a handle member for gripping between two fingers; |
| 4,211,445 | Woods 1980 | A hand-held soap-holder comprising a flexible pad, suction cups, a flexible friction surface, and an elongated flexible stem for gripping between two fingers; |
| 572,281 (British) | Watwills 1945 | A sink-side receptacle used for storing and drying a bar of soap when not in use, and including suction cavities and a piercing pin for soap attachment |

SUMMARY OF THE INVENTION

The problem of holding a slippery bar of soap during bathing is well known. It is a problem that apparently has existed since the time of the Roman Empire, when early forms of bar soap are believed to have first appeared. The popular modern habit of bathing by shower has served to compound the problem. Wet, slippery bar soap can be particularly difficult to handle when the user is standing under a shower of water, where the soap is used more vigorously and held more precariously, and where speed of cleansing is often important.

Despite the efforts of previous inventors, and considering the limited convenience and practicality of "soap-on-a-rope" devices, the current marketplace appears void of a single alternative product that consumers can turn to. The problem of controlling or dropping the soap while showering, or losing the soap while tub-bathing, has received broad consumer resignation as an unavoidable nuisance. For many, it is a source of real aggravation.

Study and experimentation has revealed the existence of at least several disadvantages in each prior art, and in prior art related to the field, with each disadvantage believed to be a potential serious handicap to commercial implementation and acceptance. Such disadvantages include, for example:

(1) The absence of an attachment means that effectively accommodates an eroding, steadily shrinking bar of soap;

(2) The absence of a capability, in a single versatile embodiment, to be effectively functional with a wide variety of soap shapes and contours;

(3) The absence of a safe, reliable means for preventing transverse movement of the device on the soap surface;

(4) The absence of a gripping element that (a) allows the gripping fingers to adjust in height and (b) allows a quick and stable exchange of the soap back and forth between hands;

(5) The absence of a structural design that is extremely sturdy, yet effectively compact.

Accordingly, this invention overcomes all of these disadvantages and others. Further objects and advantages of the invention are: to provide a new and improved hand-held soap holding device which is readily manufactured and used; to incorporate advantages that allow superior performance and reliability in normal, vigorous shower use, as well as tub-bath and sink-side use; to provide a device that is safe, easy to clean, and convenient to use; to provide a device that is easily attachable and detachable by ordinary consumers to commercially available bar soaps; and to reduce soap waste by allowing the soap to be used down through sizes smaller than can be effectively held in the bare hand.

A more particular object of the invention is to provide, in a preferred and versatile embodiment, a relatively small disk-like pad, or base-pad, of resilient, rubber-like material incorporating on one side an array of relatively small-diameter suction cups for vacuum attachment to a surface of soap. The array is divided into two concentric inner and outer arrangements of suction cups. Projecting on the opposite side is an elongated stem for comfortable gripping between two adjacent fingers of the user's hand. The stem is integral to an underlying, broadened support-base, which is centrally located within the base-pad. The support-base overlies the inner arrangement of suction cups. Projecting from within each suction cup of the inner arrangement is a blunt, relatively small peg.

As the soap-holder is applied to the wet soap by the user, the suction cups are evacuated and consequently adhere to the soap surface. At the same time, the pegs are implanted into the soap surface, and the device is effectively stabilized for use. The soap-holder and the bar of soap are essentially integrated and function as a single unit.

The base-pad includes an outer-portion, or support-flap, which overlies the outer arrangement of suction cups, and is free to flex and bend. Consequently, the support-flap allows the soap-holder to conform to a wide variety of soap shapes and contours, to include oval, convex, concave, flat, semi-flat, etc. The support-flap contributes significant attachment stability and allows continued attachment to the bar of soap as the bar erodes and shrinks during use-life.

These objects and advantages, together with others, will become apparent from the following description taken in conjunction with the accompanying drawings, wherein:

DESCRIPTION OF PREFERRED EMBODIMENTS

Figure 1:
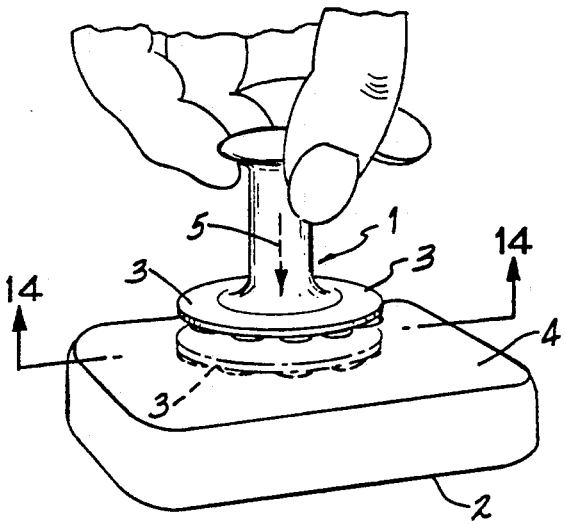
FIG. 1 is a perspective view showing one embodiment of the soap-holding device being attached to the surface of a bar of soap.

With regard to a preferred embodiment, and referring to the drawings, and first considering FIGS. 1–7, a hand-held soap-holder is indicated generally at 1 and will be applied to a wet bar of soap 2 by pressing base-pad 3 of the device onto surface 4 of the bar of soap in the direction indicated by direction of arrow 5. The device 1 adheres at the bottom side of its base-pad 3 in juxtaposition on the soap as indicated by phantom lines in FIG. 1.

Figure 2:
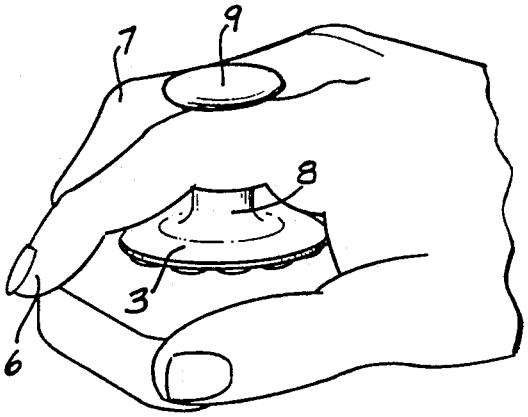
FIG. 2 is a perspective view of the device of FIG. 1, illustrating how the device is held and used after being attached to a bar of soap.

As seen in FIG. 2, and illustrating substantial actual size relationships, with the user's hand and fingers depicting an average male adult size, the user will place index finger 6 and middle finger 7 in straddling relationship about the stem 8 above base-pad 3 and beneath knob 9 of the device; this facilitating an auxiliary hand-grasp of the soap between the thumb and remaining fingers of the hand.

A bar of soap is broadly defined to include any relatively solid, or firm, erodible cleansing material of generally soap-like character, regardless of what other substances it may contain, such as skin cream, skin moisturizers, medication, etc.

Figure 3:
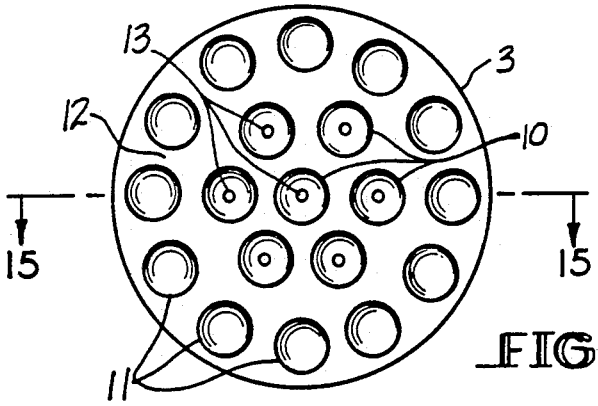
FIG. 3 is a bottom plan view of the soap-holding device of FIG. 1 on an enlarged scale, looking generally from the plane of line 14—14 of FIG. 1.

Referring to FIG. 3, the soap-holder base-pad 3 comprises a circular, disk-like, relatively planar member with a preferred diameter of substantially 2.00 inches (or substantially 5.08 centimeters). Depending from member 3, as seen in this bottom plan view, is a plentiful array of relatively small-diameter suction cups, including an inner circular arrangement 10 and an outer circular arrangement 11. Base-pad 3 includes an outward support-flap portion 12, which overlies the outer circular arrangement of suction cups 11. A relatively small peg 13 projects outwardly from within each suction cup of the inner circular arrangement of suction cups 10, which includes a suction cup located centrally within that arrangement.

Figure 4:
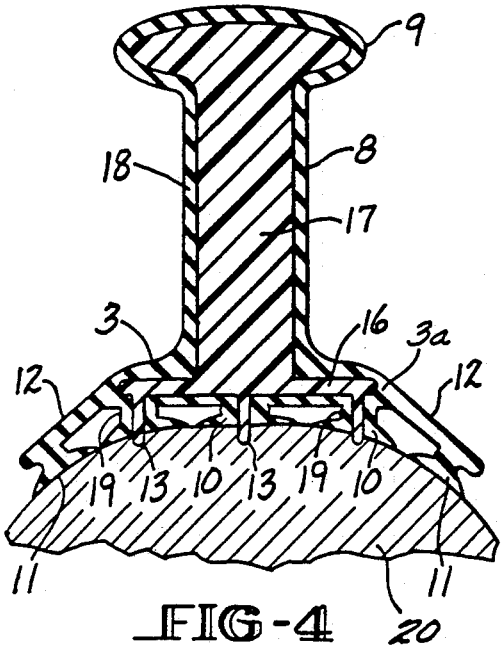
FIG. 4 is an enlarged, elevated section, taken generally on the plane line 15—15 of FIG. 3, and shows how the device accommodates to a convex surface of a bar of soap.
Figure 5:
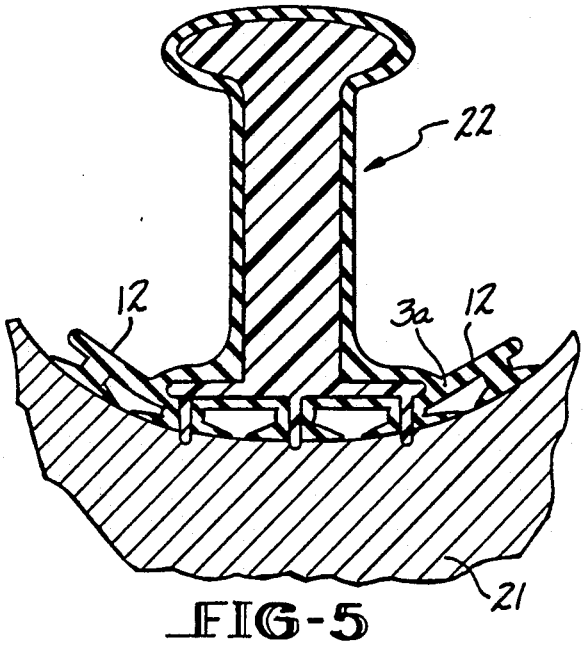
FIG. 5 is view similar to FIG. 4, showing how the soap-holding device accommodates to a concave surface of a bar of soap.

Referring to FIGS. 4 and 5, the device is shown in two enlarged sectional views illustrating the results of a preferred injection-molding manufacturing process in which stem 8, enlarged knob 9, support-base 16, and pegs 13 are constructed as a one-piece, substantially rigid, integrated core unit 17. Outer-form 18 is subsequently injection-molded while encompassing core unit 17, forming all of the following with the same material: base-pad 3 with its support-flap 12 portion; suction cups 10 and 11; connecting necks 19; and the outer sheaths to stem 8 and knob 9. It is noted that support-base 16 is, therefore, substantially embedded, or encased, within base-pad 3, with the exception of the base-support's upper junction with stem 8.

Core unit 17 is produced as a substantially rigid plastic material that resists breakage, cracking, or distortion. Outer-form 18 is constructed of a resilient, flexible, rubber-like material that effectively retains those properties under long-term exposure to soap and water.

A two-part injection molding method, as generally described above, with an outer-form molded over all, or part, of a core unit, combines the advantages of a relatively inexpensive manufacturing process with an end result of maximized structural and functional integrity for the soap-holder.

Stem 8, of FIGS. 4 and 5, forms a securing element to be comfortably gripped between two adjacent fingers of the user's hand. The stem terminates with enlarged knob 9, or stop-portion, which serves to prevent stem 8 from inadvertently slipping through the user's fingers. Knob 9 additionally serves as an effective "push-platform", or abutment portion, for use in initially applying the device to the soap through downward pressure on the stem.

Support-base 16 is shown as a centrally-located, circular base-plate which serves to stabilize stem 8 by providing a significantly broader base diameter and by remaining in relatively close, tight, proximity to the surface of soap 20 or soap 21. Forces placed upon stem 8, and acting to disengage the device in a generally lateral direction, simultaneously pass through support-base 16 to underlying pegs 13, which are implanted, or embedded, within the underlying soap. Pegs 13 effectively prevent the suction cups from disengaging or slipping in generally lateral directions over the soap surface. The stem, therefore, remains in a stable, upright position during use.

Support-base 16 additionally serves to maintain underlying suction cups 10 in an essentially coplanar, cohesive grouping, allowing the suction cups to function essentially as a single unit, resulting in a significant total aggregate increase in suction strength.

Pegs 13 are shown cylindrical in shape, with limited projected length and with blunt, smoothly rounded tips. Pegs 13 have been found to be safe and harmless if contacting or rubbing against the user's skin, which might occur when the attached soap becomes nearly depleted at the end of the soap's use-life. The total displacement volume of the portions of the pegs implanted is small enough to allow the user to conveniently apply moderate pressure to achieve that implantation, without tools and without otherwise modifying the soap surface.

Suction cups 10 and 11, having adhered to the soap surface, serve to effectively prevent disengagement in a generally vertical direction from the soap surface. The combined prevention of generally vertical and lateral disengagement movement, by the suction cups and pegs 13, respectively, has the consequential effect of preventing oblique disengagement movement (i.e., directional movement falling at some degree between vertical and lateral).

Necks 19, connecting suction cups 10 and 11 to member 3, are essentially flexible and compressible in construction, serving to allow slight, but significant, pivoting or adjusting of the suction cups, as illustrated in FIGS. 4 and 5. With significantly narrower diameters than their connected suction cups 10 and 11, the necks serve to focus generally vertical disengagement forces toward the center of each evacuated suction cup, thereby preserving the critical attachment seal at the circumference of the suction cup. When of sufficient height, the necks also serve to prevent their connected suctions cups from collapsing backwards and adhering to soap residue, which may build up behind the suction cups on the underside of the base-pad.

Necks 19 of the inner circle of suctions cups encompass pegs 13, allowing the pegs to serve as stabilizing core elements to the necks, permitting the necks to compress and adjust in necessary minute ways, but preventing them from wavering or partially flopping beneath support-base 16. An additional advantage of encompassing pegs 13 within necks 19 is the resulting minimized, free-standing peg projection length outwardly from the base-pad. That minimized length, in which an individual peg does not openly protrude, or become free-standing, until it extends outwardly from within a suction cup, further enhances the safety factor of each peg.

Further advantage is gained as the suction cup, when compressed against the soap surface, effectively shields the underlying, embedded peg and the soap adjacently surrounding the peg from the effects of water. This shielding delays and minimizes the softening and erosion of that surrounding soap, which can gradually, negatively affect embedment stability.

Support-flap 12, lying outwardly from support-base 16, is free to flex and bend, and adapt to differing, original shapes and curvatures presented by commercial soaps, while providing substantial attachment stability to the device, as illustrated in FIGS. 4 and 5. As the soap erodes and shrinks during use-life, support-flap 12 will continue to adapt and continue to provide that stability. At the same time, base-pad 3 will continue to serve as an effective, broadened platform for the fingers to rest or press upon, when required by the hand's position. FIG. 4 illustrates the device when attached to a commercial soap 20 of convex curvature. In FIG. 5, and generally indicated at 22, that same device device is shown when attached to a commercial soap 21 of concave curvature.

The embedment, or encasement, of support-base 16 within the material of base-pad 3, as exemplified in FIGS. 4 and 5, provides the advantages of a water-tight, highly integral functioning of those two members and the avoidance of a separate, adhesive construction material to assure that functioning. A consequential and most important further advantage is the providing of a flex-point 3-*a*, or primary bending point, located on support-flap 12 along its junction with support-base 16, that ruggedly resists being structurally loosened or torn away from the support-base. The support-flap and embedded support-base, therefore, can remain effectively inseparable over the use-life of the device, which may include handling or storage abuse by the user, such as hyperflexing, tugging, or mashing of the support-flap.

While support-flap 12 readily accommodates convex and concave soap curvatures, and close variations thereof, it also serves as a major advantage for use with many commercial flat-surfaced soaps, as exemplified by soap 2 in FIG. 1. Flat-surfaced soaps are defined as soaps providing, in their original design by the manufacturer, an essentially planar side on which the soap-holder is to be attached.

When used with devices of the invention, flat-surfaced soaps have been found to erode more toward their outer margins, or away from the central area of planar surface. This gradually results in the original planar surface becoming rounded to some degree, particularly toward the middle and latter stages of the soap's use-life. This same uneven erosion process has been found to also occur when flat-surfaced soaps are used in the bare hand (i.e., without a soap-holder). The degree and manner of the erosion can vary according to the brand of flat-surfaced soap being used. Whatever uncertainties are presented by the gradual disappearance of the original planar surface, support-flap 12 has been found to readily adapt to those uncertainties.

Selection of a suitable, resilient, rubber-like construction material, and its dimensional thickness, which includes support-flap 12 should ultimately result in a correct balance between (1) providing a support-flap that contributes substantial attachment support for the device during use, and (2) providing a support-flap that continues to remain in fixed attachment when the soap is not in use.

During the gradual drying of the soap between uses, the loss of surface liquid or moisture, which had acted as a sealant, greatly weakens the bonds between the compressed suction cups and the soap surface. Excessive tension, or stiffness, existing in the flexed position of an overlying support-flap can then gradually (usually over a period of hours) uplift and disengage all, or a portion, of the underlying, outer arrangement of suction cups. (This would not apply to an attachment surface of concave curvature.) The result is a device that is not effectively and conveniently ready for subsequent or next-day use. Consequently, the user must then moisten the soap and manually re-compress the suction cups underlying the support-flap, or completely detach and then reattach the device.

In the opposite concern, a support-flap with deficient flexing tension, while not disengaging those weakened bonds, contributes relatively poorly to the attachment support and reliability of the device during use. Deficient flexing tension is primarily the result of the support-flap material being comparatively overly soft and/or easily stretchable. To achieve the major advantage of having a reliable, working soap-holder that remains reliably ready for subsequent or next-day use (without the nuisance of adjusting or re-attaching the suction cups), the somewhat delicate, functional balance between excessive flexing tension and deficient flexing tension must be carefully considered in the construction of the device.

A preferred circular, or disk-like, shape of base-pad 3, as shown in FIG. 3, allows quick, convenient attachment of the soap-holder at the approximate center of the soap surface, without orientation to a specific direction. This is a significant advantage for a typical user, who might lack the patience for a careful alignment of the device on the soap. Should the user wish to detach the device from the soap, this can be conveniently performed by first pinching and slowly peeling back base-pad 3 from a point along its outer edge.

A preferred, substantially 2.00 inch diameter (or substantially 5.08 centimeters) of base-pad 3 has been found, if incorporated with other elements of the invention, to be of ample width to effectively support and maintain a wide range of commercial soap sizes, starting with the largest and heaviest versions. Additionally, the above described diameter has been found to be of ample width to function as an effective finger rest for even the larger male adult hand sizes.

At the same time, the above described diameter has been found to be of sufficiently narrow width to effectively minimize possible overhang of support-flap 12 beyond the outer peripheries of the soap, particularly during the latter stages of the soap's use-life, when the soap becomes increasingly narrower. Consequently, this minimized overhang prevents, or greatly limits, support-flap 12, and underlying suction cups 11, from rubbing the skin surface in a manner disrupting the smooth, controlled use of the device.

The previously described concentric inner and outer arrangements of suction cups allow for maximum effective use of the limited space available for suction cup construction beneath their respective overlying circular members (i.e., support-base 16 and support-flap 12). While necessarily maintaining necks 19 of flex-point 3-*a*, adjacent to the circular junction of the support-base and support-flap, these concentric arrangements additionally provide effective omni-directional support against stresses transferred from the centrally located stem 8.

Referring again to stem 8, the rounded shape of its length provides a comfortable gripping element at any orientation to the fingers. Additionally, the stem is preferably textured, ribbed, or otherwise constructed along its length to prevent possible uncontrolled rotational slippage of member 8 between the fingers, due to water or soap residue. Some slight, but controlled, rotational movement, however, has been found to be a desirable feature of stem 8, as the soap-holder is maneuvered over different contours of the body.

The significantly elongated, unbending construction of stem 8, as shown in FIGS. 1 and 2, and FIGS. 4 and 5, creates an essentially vertical "travel-portion" for the fingers on the stem, thereby providing a major functional advantage by allowing a range of gripping heights by the two adjacent gripping fingers. This range permits the hand to raise, lower, and consequently angle its position relative to the underlying soap. The general diameter, or width, or any variance thereof, along the stem is such that the two gripping fingers remain in comfortable straddling position while easily utilizing the "travel-portion". The varied gripping heights, which include slight or subtle differences, allow the hand significantly more control and maneuverability, as required by different reaches of the arm and hand at different areas of the body, and by changes in soap size during use-life. This control and maneuverability is of particular advantage when the user is in a standing shower situation.

Another, and equally advantageous, function of the "travel-portion" is its use as a "target" and exchange point during the ambidexterity process in which the soap is repeatedly, and often rapidly, exchanged between the user's hands. The process (with or without the use of a soap-holder) has been found to be a significant, normally subconscious, event that is most common in the shower. The process is often performed in a "blind" manner, in which the user does not look directly at the exchange, or, because of water and/or steam in the air, the user cannot effectively see the exchange. The prominent, unbending, omni-directional accessibility of the "travel-portion" of rounded stem 8 allows a quick and stable exchange, without awkwardness or hesitation.

The design of stem 8 is specifically intended for use as a gripping element between two, straddling, adjacent fingers of the user's hand, within, or generally toward, the crotch of those fingers. Improper use of the stem during bathing, as, for example, by holding onto knob 9 and using the stem as a mere extension member is likely to provide less efficient use and to destablilize support-base 16.

Devices of the invention might include alternative members that vary greatly from stem 8 in general shape and design. For certain situations, a relatively short stem, with an essentially snug fit of the user's adjacent fingers between the base-pad and the knob, might be utilized. Such a stem could be suitable, for example, during a leisurely tub-bath or during sink-side use, without the advantages of varied gripping heights and quick ambidexterity of use. Another alternative might resemble a closed-loop, which could be utilized for insertion by the middle finger, with presure against the loop provided by fingers to either side of that middle finger. Also, for example, a relatively long, gripping member, including a "travel-portion", might extend upwardly at an oblique angle and terminate with a Y-shaped stop-portion.

Figure 6:
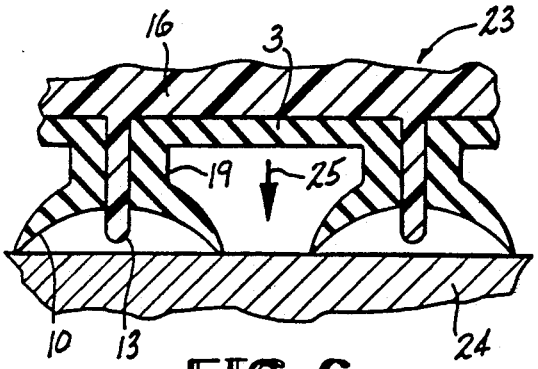
FIG. 6 is an elevated, greatly enlarged, fragmentary sectional view of several suction cups of FIG. 1 (i.e., those centrally of the device), illustrating the relaxed state of the suction cups before they are applied and secured to a bar of soap and before the pegs are implanted in the soap.
Figure 7:
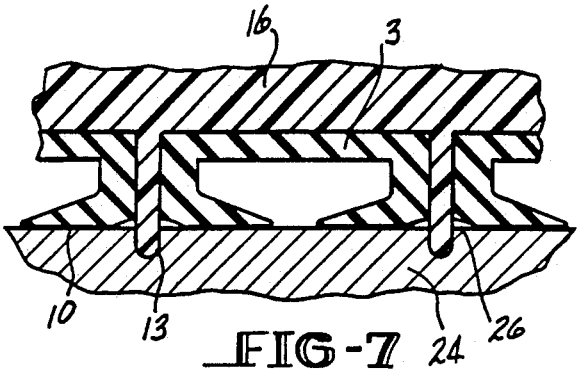
FIG. 7 is a view similar to FIG. 6, showing the pegs implanted in the soap and the surrounding suction cups exhausted of air within and urged into secure engagement to the soap by virtue of an existing pressure differential.

With regard to a primary attachment method of the invention, and referring to FIG. 6 an enlarged, fragmentary, sectional view of FIGS. 4 and 5 is shown generally at 23. Two small-diameter suctions cups 10 are shown in relaxed state before they are attached to the wet surface of soap 24. When pressure is applied through base-support 16 in the direction of arrow 25, and now referring to FIG. 7, pegs 13 are implanted within soap 24. At the same time, surrounding suction cups 10 are essentially evacuated of air within and adhere to the soap surface. A vacuum chamber 26 may occur centrally within each compressed suction cup.

A preferred compressed diameter size for the suction cups in the device of FIGS. 1–7, is substantially 0.36 inch (or substantially 0.91 centimeter). A preferred range of compressed diameter sizes to be considered for a majority of other devices of this invention, depending largely on the specific configuration of each suction cup array, falls substantially between 0.20 inch (or 0.51 centimeter) and 0.50 inch (or 1.27 centimeters). The term "compressed diameter" is a measurment of the maximum width of a flattened cup during effectively full compression against a firm, flat surface.

The manufactured concave, or cup-like, feature of a suction cup in a relaxed state, as shown in FIG. 6, may eventually become distorted after prolonged compression against soap surfaces. This distortion, which can vary in degree depending on original design and/or the material used in its construction, may render the suction cup permanently more saucer-like or virtually flat in shape in its relaxed state (i.e., when not compressed against a soap surface). Nevertheless, such distortion has not been found to necessarily be a disadvantage in the effective functioning of the suction cup. Devices of the invention may include suction cups, which, unlike FIG. 6, are originally manufactured in that more saucer-like shape or virtually flat shape. They may also include suction cups that deviate from the standard circular shape when compressed.

In summary of FIGS. 1–7, a device of the invention is shown that is extremely sturdy and compact in construction, and versatile in its compatibility to a wide range of common commercial soaps of different sizes, shapes, and contours. The device can be attached quickly and easily to a bar of soap, without orientation to a specific direction. When used correctly, the device allows a high degree of attachment reliability, ranging from the rigors of shower use to the more docile sink-side use, as the soap evolves in size through its use-life.

Figure 9:
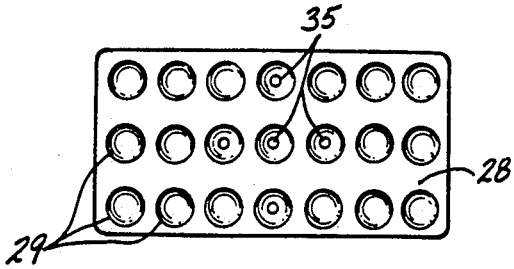
FIG. 9 is a bottom plan view of FIG. 8, showing a comparatively long, rectangular support-base with rows of suction cups and a plurality of pegs.
Figure 8:
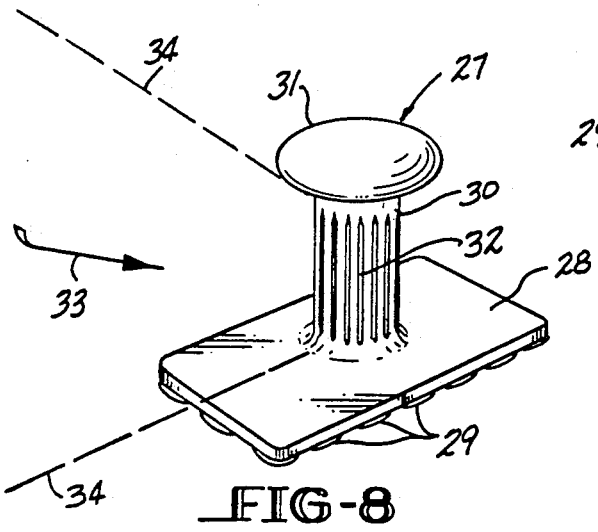
FIG. 8 is a perspective view of another embodiment, designed for use with certain flat-surfaced soaps.
Figure 10:
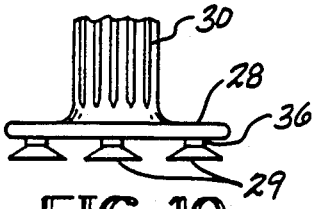
FIG. 10 is fragmentary, end elevational view of FIG. 8, showing its comparatively narrow support-base width.

Illustrating another preferred embodiment of the invention in FIGS. 8–10, and referring specifically to FIG. 8, a soap-holder is shown generally at 27 which is designed for use exclusively with certain flat-surfaced soaps. Support-base 28 is of substantially rigid, unbending construction and is rectangular in shape and comparatively narrow in width. In the absence of one or more support-flaps, the elongation of support-base 28, with a correspondingly extended underlying suction cup configuration, provides increased attachment support. Not suited for all flat-surfaced soaps, this device is designed for those flat-surfaced soaps which, due to qualities of their ingredients, erode more uniformly, absorb less water, and remain generally firmer and sturdier during use.

Stem 30 of this embodiment, with knob 31, are of similar function and material construction as corresponding members in the device of FIGS. 1–7. The stem includes longitudinal ribbing 32, which serves to reduce slippage between the gripping fingers, yet allows some desired rotational movement of the stem. The general degree of elongation as shown on stem 30 provides a prominent exchange point during the previously described ambidexterity process. Arrow 33 and angle lines 34 serve to illustrate a relatively wide angle of aim available for the non-gripping hand as one of several possible exchange techniques is initiated.

FIG. 9 is a bottom plan view of FIG. 8 in which rows of suction cups 29 project outwardly from support-base 28. Projecting outwardly from within suction cups 29 of a portion of the configuration are pegs 35. The support-base, suction cups, and pegs are of similar function and material construction as related members described in FIGS. 1–7. Stem 30, elongated support-base 28, and pegs 35 function as a substantially rigid unit, along the relatively narrow attachment plane extending longitudinally and centrally on the soap surface.

Similar to the device described in FIGS. 1–7, a preferred construction method for this embodiment would involve a one-piece, molded core unit including the stem, the support-base, and the pegs, with a one-piece molded outer-form essentially serving as a rubber-like covering, or sheath, and providing the suction cup constructions.

FIG. 10 is a fragmentary end view of FIG. 8 showing the relatively narrow width of support-base 28 with overlying stem 30 and underlying suction cups 29 with connecting necks 36. Carefully aligned centrally along the soap's length, the support-base, with a preferred width of substantially 1.00 inch (or 2.54 centimeters), would remain slightly inside and away from any major erosion, or rounding, occurring toward the soap's lateral margins.

Figure 11:
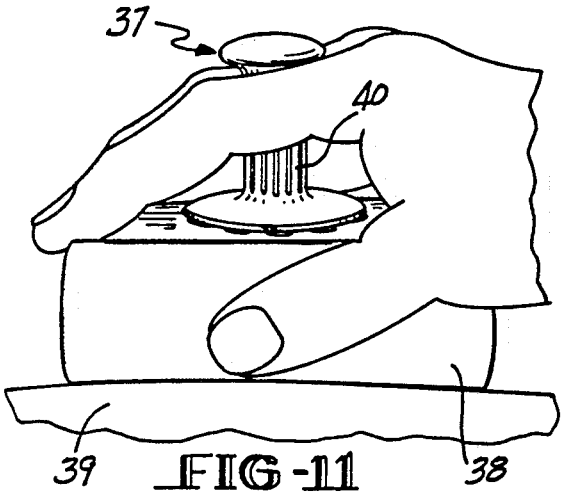
FIG. 11 is a perspective view showing the position of the user's hand while maneuvering the soap-holder and attached bar of soap.
Figure 12:
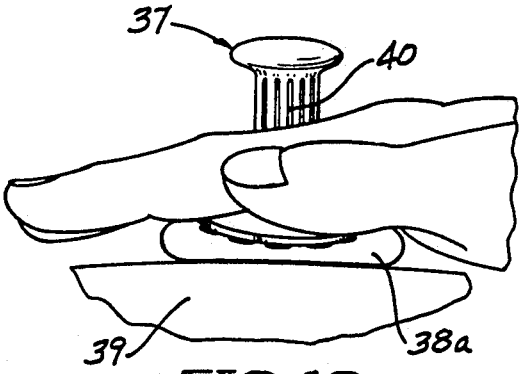
FIG. 12 is a perspective view similar to FIG. 11, showing the same soap after it has eroded and shrunk, with the hand engaging the soap-holder in a necessarily different manner for maneuvering purposes.

Referring to FIGS. 11 and 12, and first considering FIG. 11, a soap-holder is generally indicated at 37 in a gripping position by the user's hand, and attached to underlying soap 38, while being maneuvered over skin surface 39 of the user's body. Soap-holder 37 is of similar function and material construction as the device described in FIGS. 1–7. FIG. 11 shows soap 38 in its new, original condition, while FIG. 12 shows the same soap (now 38*a*) nearing the final stages of its use-life after numerous showers.

The use of the essentially vertical "travel-portion" 40 of the elongated stem is demonstrated in part by a comparison of the hand positions in FIGS. 11 and 12. The user's hand in FIG. 11 is required to be generally cupped, with fingers extended at downward angles to contact and grip the soap. This general position has been found to be important in allowing the user to control and maneuver the relatively larger size and weight of soaps in their new, original condition and during early stages of use-life.

FIG. 12 shows a common hand position required when soap 38*a* has been greatly reduced from original size, when its original outer portions have disappeared. The center of gravity of the device and integrated soap, as a functioning unit, has greatly altered; the user's hand is now in relatively flat position with the fingers extended essentially horizontally; and the fingers and palm have been brought to direct or closer proximity to the support-base for more subtle control of the smaller soap 38*a* over skin surface 39.

A preferred range of lengths to be considered for the "travel-portion" of the device of FIGS. 11 and 12 falls substantially between 1.10 inches (or 2.79 centimeters) and 1.60 inches (or 4.06 centimeters). The length of a "travel-portion" refers to the degree of elongation on the stem that provides the advantages as previously described and illustrated in the above embodiments of the invention. Dimensions within the above range have been found to effectively accommodate virtually all hand sizes, ranging up to large-size male adult hands, in a manner allowing those previously described advantages. For manufacturing and commercial practicality, it is possible within the above range to establish several specific, averaged "travel-portion" lengths in which the device might be sold, for example, in sizes marked simply as large, medium, and small.

Figure 13:
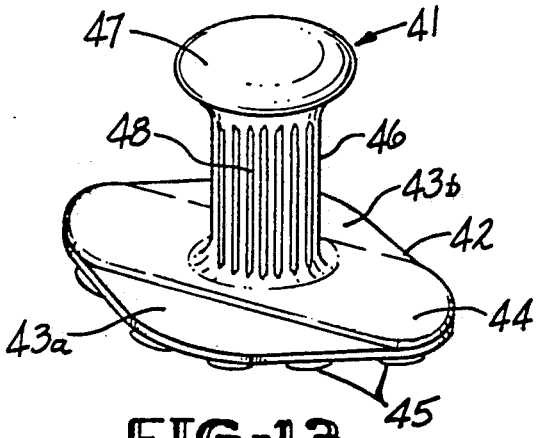
FIG. 13 shows another embodiment of the invention, designed for use with flat-surfaced soaps and incorporating an elongated support-base combined with side support members.
Figure 14:
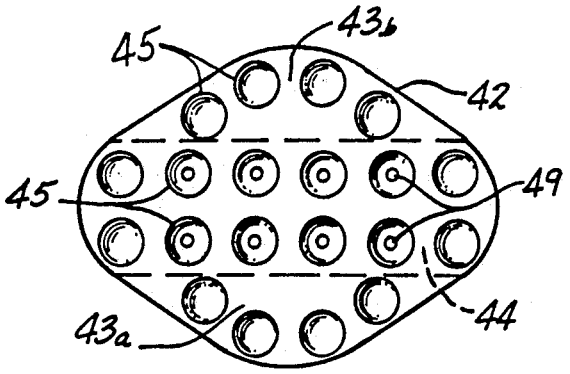
FIG. 14 is a bottom plan view of FIG. 13, showing suction cups with pegs, and illustrating the support-base in phantom lines.
Figure 15:
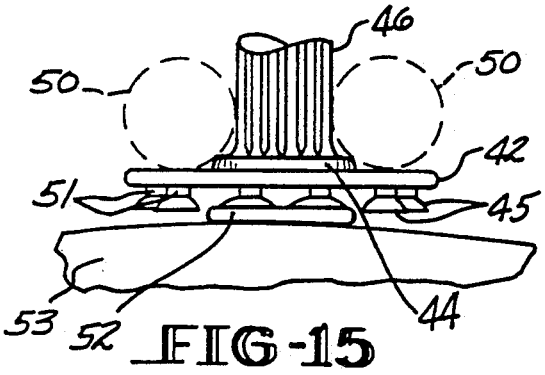
FIG. 15 shows a fragmentary, front elevational view of FIG. 13 with the user's gripping fingers illustrated in phantom lines and a small, nearly depleted, piece of soap still in-use.

Referring to FIGS. 13–15, and first to FIG. 13, another embodiment of the invention is indicated generally at 41. The members of this device are essentially similar in function and material construction as related members in the device of FIGS. 1–7, with several significant differences. As shown in FIG. 13, those differences include the use of a base-pad 42 which includes two, separate, flexible support-flaps 43*a* and 43*b* extending outwardly on opposite sides of support-base 44, which has a relatively long, narrow dimension. Suction cups 45 depend from the bottom side of the device, and an elongated stem 46, with knob 47 and longitudinal ribbing 48, extends upwardly from support-base 44. While a preferred manufacturing method for this embodiment would include a two-part injection molding, similar to that described for the device of FIGS. 1–7, alternative methods, including substantial piece-by-piece assembly, might be used.

The bottom plan view of the same device, shown in FIG. 14, indicates support-base 44 within phantom lines, with support-flaps 43*a* and 43*b* extending outwardly of the support-base on opposite sides of base-pad 42. Small-diameter suction cups 45 encompass pegs 49 as indicated. FIG. 15 is a fragmentary, front elevation of FIG. 13 with the user's two adjacent fingers indicated in phantom circles 50 while straddling stem 46. Support-base 44 lies within base-pad 42, while suction cups 45 and necks 51 depend downwardly from beneath the device. Soap 52 remains attached to a centrally located portion of the suction cup array while being applied to the user's skin 53. Soap 52, which is shown in the very final stages of its use-life, represents a tiny remnant of what was originally a relatively heavy, "family size" bar of soap, which commonly weigh about 7 ounces (or 198 grams).

The design of base-pad 42 in FIGS. 13–15 the soap-holder's attachment stability and reliability with flat-surfaced soaps by incorporating the major advantage of an elongated support-base combined with dual-sided support-flaps. As with the device of FIGS. 8–10, proper attachment of this embodiment to the soap would require a centered longitudinal placement by the user.

Figure 16:
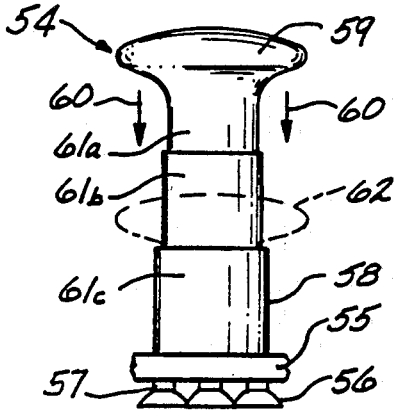
FIG. 16 is an enlarged, fragmentary, elevated view of a gripping element of telescopic design, which can be extended and compressed.

FIG. 16 shows a soap-holder in narrow, fragmentary, elevated view indicated generally at 54 with support-base 55, suction cups 56, and necks 57. Stem 58 is shown as a three-section, extension element that is extendable (i.e., telescopic) and compressible in design. Knob 59 serves as a previously described stop-portion. When fully compressed, or collapsed, in the direction indicated by arrows 60, the two upper sections 61*a* and 61*b* are enclosed within the bottom section 61*c*, with knob 59 indicated by phantom line 62. When fully extended, stem 58 is locked and secured in position through the use of small internal flanges and ribbing, which will also provide intermediate locking positions. Advantages of the device of FIG. 16 include its compact use for travel or storage purposes and allowing the stem's length to be "fitted" for the user's individual hand size, which would include utilization of the previously described "travel-portion".

Figure 17:
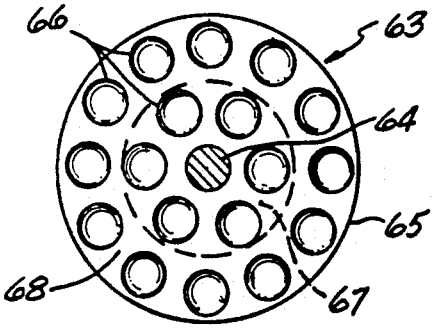
FIG. 17 is a bottom plan view of yet another embodiment of the invention which includes a relatively small, central post intended for implanting into a pre-formed opening in the bar of soap.
Figure 18:
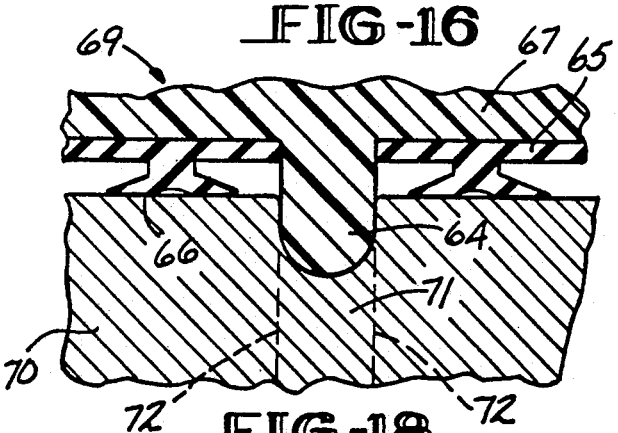
FIG. 18 is a greatly enlarged, fragmentary, elevated, sectional view showing the central post in FIG. 17 implanted in the pre-formed opening.

FIGS. 17 and 18 demonstrate a soap-holder of the invention intended for use with soaps that have been manufactured, or modified, to accept the device. That modification, as shown, can include an opening, or hole, centrally located in the soap surface which would accept the implanting, or insertion, of a small, projecting post on the bottom side of the device. FIG. 17, a bottom plan view of the soap-holder indicated generally at 63, shows projecting post 64 located centrally on base-pad 65. Small-diameter suction cups 66 are similar in function and material construction to suction cups in previously described embodiments. Support-base 67 is indicated within circular phantom line and is similar in function and material construction as related members in previously described embodiments. Lying outwardly of the support-base is flexible, rubber-like support-flap 68, which fully encompasses the support-base and performs similar functions as related members previously described.

Referring to FIG. 18, a greatly enlarged, fragmentary, elevated, sectional view shown generally at 69, includes the substantially rigid projecting post 64, shown implanted within opening 71, or hole, which is indicated between phantom lines 72. Suction cups 66 depend from a portion of base-pad 65 and are attached to the surface of soap 70. With that implantation, the projecting post 64, which is integral to overlying support-base 67, can serve a function similar to the pegs of previously described embodiments, that being to effectively prevent lateral slipping of the device on the soap surface. While post 64, as illustrated, should effectively fulfill that function, more than one post might be used.

Post 64 is of generally cylindrical shape and terminates in a blunt, rounded tip, so designed as to be safe and harmless if contacting or rubbing against the user's skin. The size of the post, significantly larger than the previously described pegs, prevents the post from being effectively and conveniently implanted within the surface of a soap that has not been manufactured, or modified, as indicated. Opening 71, as shown, is formed in the soap manufacturing process, or can be created by the soap user with the aid, for example, of a small drilling, or twisting, hand-tool designed specially for that purpose.

Preferably, the opening would extend through the entire width of the soap, which would allow attachment, or re-attachment, of the soap-holder to either side of the soap. Additionally, a relatively small insert, made of plastic or other suitable material, might first be placed within opening 71 to accept the post and reinforce the hole. Such an insert could allow the post to lock into position by twisting or otherwise securing within the insert.

The opening, in cross-section, could be round, oval, square, X-shaped, slot-like, or of other shape that would accept a correspondingly shaped post projecting from the bottom side of the soap-holder. A significant commercial advantage of the device of FIGS. 17 and 18 would be in its sale and use only for specifically intended soaps (i.e., those with a corresponding opening).

Figure 19:
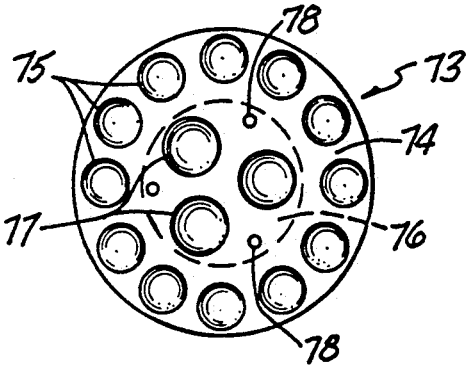
FIG. 19 is a bottom plan view of still another embodiment of the invention, showing free-standing projecting pegs (i.e., not projecting from within suction cups)

FIG. 19, indicated generally at 73, illustrates a bottom plan view of another embodiment. Support-flap 74 and an underlying outer concentric arrangement of suction cups 75 lie outwardly from the base-support 76, indicated within circular phantom line. An inner arrangement of suction cups 77 and pegs 78 directly underlie the base-support. Pegs 78 are free-standing and, unlike previously described pegs, are not encompassed by suction cups or connecting necks. The embodiment is used in essentially the same manner, and constructed of the same materials, as previously described similar embodiments. An advantage of the device of FIG. 19 is the permitting of a simplified manufacturing process, to include hand-crafted assembly, in which the construction of pegs within small-diameter suction cups, a comparatively exacting procedure, could be avoided.

Figure 20:
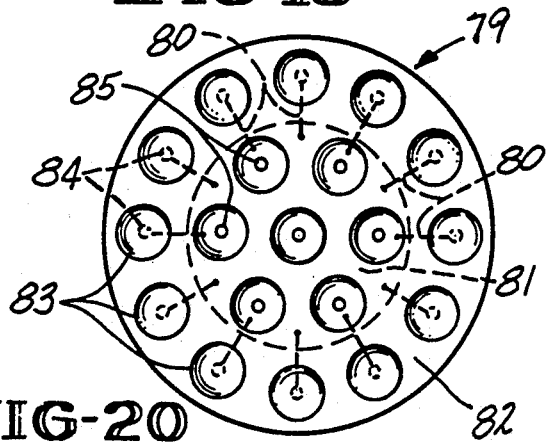
FIG. 20 is a bottom plan view similar to FIG. 3, with the addition of non-elastic, thread-like supportive members illustrated in phantom lines.

FIG. 20 illustrates still another embodiment of the invention indicated generally at 79 and similar in function and material construction as the device of FIGS. 1–7, with one major addition. Corresponding to FIG. 3 and its bottom plan view, FIG. 20 shows the additional construction of a plurality of thread-like filaments 80, indicated by phantom lines, extending longitudinally and outwardly from anchored positions within base-support 81, indicated within circular phantom line. Filaments 80 continue internally through support-flap 82 and terminate in disk-like filament portions 84, which are in anchored positions overlying suction cups 83 of the outer concentric arrangement. Pegs 85, within the inner arrangement of suction cups, correspond to the pegs of FIG. 3.

Filaments 80 and filament portions 84 are constructed of a suitable material, such as a nylon or fiber-glass, which has the characteristic of being easily flexed, or bent, but, at the same time, remains essentially non-elastic, or resistant to stretching, beyond its original length. While shown as thread-like in FIG. 20, the filament members may also be designed as generally ribbon-like or strip-like in construction and may be integrally situated above, below, or internally within the support-base and support-flap.

While integral to support-flap 82, filaments 80 do not interfere with the support-flap's necessary ability to properly flex and bend and conform to the underlying soap surface. However, the non-elastic quality of the filaments effectively prevents stretching of the support-flap area between the support-base and any portion of the outer arrangement of suction cups. The absence of such stretching creates an improved, mutually stabilizing link between base-support 81 and outer suction cups 83, thereby further enhancing the functional reliability of the device.

A full and complete description of the invention has been disclosed in accordance with the Statutory requirements; it is to be understood that the invention is not limited to the specific embodiments disclosed herein. Accordingly, modifications may be resorted to without departing from the spirit of the invention or the scope of the appended claims.

What is claimed is:

1. A hand-held soap-holder for attachment to a bar of soap; and comprising in combination:
- finger-gripping means;
- support-base means;
- suction means;
- implanting means; and
- support-flap means;
  - said finger-gripping means extending generally upwardly from said
  - support-base means for use in securing said soap-holder in a user's hand;
- said support-base means being of substantially rigid construction and being integrally positioned as to substantially underlie said finger-gripping means, substantially overlie said implanting means, and substantially overlie some portion of said suction means;
  - said suction means including an array of flexible suction cups disposed outwardly from beneath said soap-holder for attachment to a bar of soap;
- said implanting means disposed downwardly from said support-base means for preventing transverse movement of the soap-holder on the surface of a bar of soap;
  - said support-flap means including at least one flexible portion, extending generally outwardly from said base-support means and substantially overlying some portion of said suction cups, whereby said flexible portion of said support-flap means is free to flex and bend, and whereby said flexible portion can conform and attach to the underlying surface of a bar of soap.

2. The structure as claimed in claim 1 in which said finger-gripping means includes a stem of substantially rigid construction extending generally upwardly from said support-base means.

3. The structure as claimed in claim 2 in which said stem is substantially rounded along at least a portion of its length; said rounded portion being of suitable general diameter as to allow a comfortable straddling of said rounded portion between two adjacent fingers of a user's hand.

4. The structure as claimed in claim 2 in which said stem includes an enlarged stop-portion, whereby said stop-portion prevents said stem from slipping through a user's hand.

5. The structure as claimed in claim 2 in which said stem includes extension means, whereby said stem is extendable and compressible in length.

6. The structure as claimed in claim 2 in which said stem includes an elongated travel-portion extending generally upwardly from said support-base means, whereby said travel-portion allows a user's hand to utilize a range of gripping heights relative to an underlying bar of soap, and whereby said travel-portion provides a prominent exchange point during the ambidexterity process.

7. The structure as claimed in claim 6 in which said travel-portion of said stem is substantially between 1.10 inches, or 2.79 centimeters, and 1.60 inches, or 4.06 centimeters, in length.

8. The structure as claimed in claim 1 in which said array of suction cups includes a substantially concentric inner arrangement and a substantially concentric outer arrangement; all of said concentric inner arrangement of suction cups being disposed substantially beneath said support-base means.

9. The structure as claimed in claim 1 in which at least one suction cup of said array of suction cups includes a flexible neck connecting said suction cup to said soap-holder.

10. The structure as claimed in claim 1 in which said implanting means includes a plurality of projecting pegs of substantially rigid construction.

11. The structure as claimed in claim 10 in which at least one peg of said projecting pegs is of substantially cylindrical shape and terminates in a blunt, smoothly rounded tip.

12. The structure as claimed in claim 10 in which at least one peg of said projecting pegs is encompassed by one suction cup of said array of suction cups and is disposed outwardly from within said suction cup.

13. The structure as claimed in claim 1 in which said implanting means includes at least one projecting post for use as an insertion element into a pre-formed opening in the surface of a bar of soap.

14. The structure as claimed in claim 1 in which said support-flap means includes two, separate, flexible portions extending generally outwardly from substantially opposite sides of said support-base means; each of said two, separate, flexible portions substantially overlying some portion of said array of suction cups.

15. The structure as claimed in claim 1 in which said support-flap means includes a filament means; said filament means including a plurality of flexible elements resistant to stretching and integrally linking said support-base means to a plurality of said suction cups underlying said support-flap means.

16. The structure as claimed in claim 1 in which said support-base means is substantially embedded, or encased, within the material of a base-pad; said base-pad including, in its construction and material, said array of suction cups and said support-flap means.

17. The structure as claimed in claim 1 in which said finger-gripping means, support-base means, and implanting means comprise a one-piece molded unit.

18. A hand-held soap-holder for attachment to a bar of soap, and comprising in combination:

finger-gripping means;
support-base means;
suction means;
implanting means; and
support-flap means;

said finger-gripping means including a stem of substantially rigid construction extending generally upwardly from said support-base means for use in securing said soap-holder in a user's hand;

said support-base means being of substantially rigid construction and being integrally positioned as to substantially underlie said finger-gripping means, substantially overlie said implanting means, and substantially overlie some portion of said suction means;

said suction means including an array of flexible suction cups disposed outwardly from beneath said soap-holder for attachment to a bar of soap; said array of suction cups including at least one suction cup supported by a neck connecting said suction cup to said soap holder;

said implanting means being of substantially rigid construction and disposed downwardly from said support-base means for preventing transverse movement of the soap-holder on the surface of a bar of soap; said implanting means including a plurality of projecting pegs;

said support-flap means including at least one flexible portion, extending generally outwardly from said support-base means and substantially overlying some portion of said suction cups, whereby said flexible portion of said support-flap means is free to flex and bend, and whereby said flexible portion can conform and attach to the underlying surface of a bar of soap.

19. The structure as claimed in claim 18 in which said support-flap means is substantially circular in shape and encompasses said support-base means.

20. The structure as claimed in claim 18 in which said support-flap means includes two, separate, flexible portions extending generally outwardly from substantially opposite sides of said support-base means; each of said two, separate, flexible portions substantially overlying some portion of said array of suction cups.

* * * * *

UNITED STATES PATENT AND TRADEMARK OFFICE

CERTIFICATE OF CORRECTION

PATENT NO. : 5,011,316

DATED : April 30, 1991

INVENTOR(S) : Victor A. Damon et al

It is certified that error appears in the above-identified patent and that said Letters Patent is hereby corrected as shown below:

Title Page:

In [57] ABSTRACT, line 8, change "soat" to -- soap --.

Col. 8, line 44, after "necks 19" insert -- off --.

Col. 12, line 28, after "FIGS. 13-15" insert -- maximizes --.

Col. 13, line 48, change "base-support" to -- support-base --.

Col. 13, line 51, change "base-support" to -- support-base --.

Col. 13, line 68 and Col. 14, line 1, change "base-support" to -- support-base --.

Col. 14, line 26, change "base-support" to -- support-base --.

Col. 14, lines 44 through 47, re-construct as one indented paragraph.

UNITED STATES PATENT AND TRADEMARK OFFICE

CERTIFICATE OF CORRECTION

PATENT NO. : 5,011,316

DATED : April 30, 1991

INVENTOR(S) : Victor A. Damon et al

It is certified that error appears in the above-identified patent and that said Letters Patent is hereby corrected as shown below:

Col. 14, line 63, change "base-support" to --support-base--.

Signed and Sealed this

Eighth Day of December, 1992

*Attest:*

DOUGLAS B. COMER

*Attesting Officer*

*Acting Commissioner of Patents and Trademarks*